United States Patent [19]

Gettemeier et al.

[11] Patent Number: 4,989,880

[45] Date of Patent: Feb. 5, 1991

[54] TOSSING GAME APPARATUS

[75] Inventors: Edward R. Gettemeier; Marsha A. Gettemeier, both of Edwardsville, Ill.

[73] Assignee: G-2 Products, Incorporated, Edwardsville, Ill.

[21] Appl. No.: 541,623

[22] Filed: Jun. 21, 1990

[51] Int. Cl.[5] ..... A63B 67/06

[52] U.S. Cl. ..... 273/336; 273/400; 273/DIG. 30

[58] Field of Search ..... 273/400, 398, 399, 401, 273/402, 336, 337, 338, 339, 346, 424, 425, DIG. 30

[56] References Cited

U.S. PATENT DOCUMENTS

| | | | |
|---|---|---|---|
| 324,189 | 8/1885 | Thomas | 273/400 |
| 1,513,968 | 11/1924 | Crandall | 273/336 |
| 2,634,982 | 4/1953 | Gaede | 273/424 |
| 3,802,704 | 4/1974 | Genua | 273/336 |
| 4,392,653 | 7/1983 | Blume, Sr. | 273/400 |
| 4,877,256 | 10/1989 | Falloon | 273/400 |

*Primary Examiner*—William H. Grieb

*Attorney, Agent, or Firm*—Haverstock, Garrett, and Roberts

[57] ABSTRACT

An improved portable target assembly for toss type games comprising a cup shaped target member centrally located on one side of a flexible mat, the flexible mat having a centrally located portion with a plurality of peripheral edge portions around said center portion and extending outwardly therefrom, the edge portions being foldable and having end portions which are cooperatively engageable in a variety of ways to form alternative configurations of upstanding side walls for containing playing pieces tossed thereat so as to enable changing the degree of difficulty and skill level required to play the game, the cup shaped target member being detachable from the flexible mat and the mat being rollable into a cylindrical shape for convenient handling and storage. The present target assembly optionally including an open ended tubular container for holding one or more flexible mats and a plurality of playing pieces and the cup shaped target member being cooperatively engageable with one of the open ends to close the container, or alternatively, locatable in the container with the flexible mats and playing pieces.

11 Claims, 3 Drawing Sheets

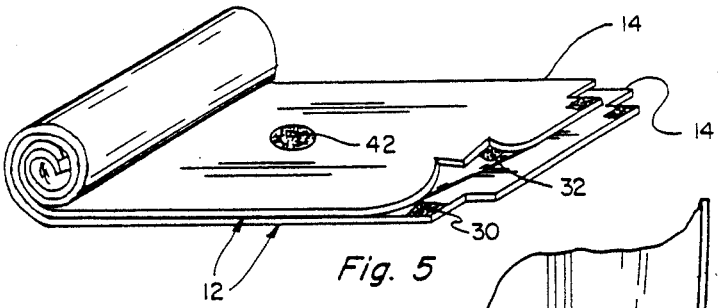
Fig. 5
Fig. 8
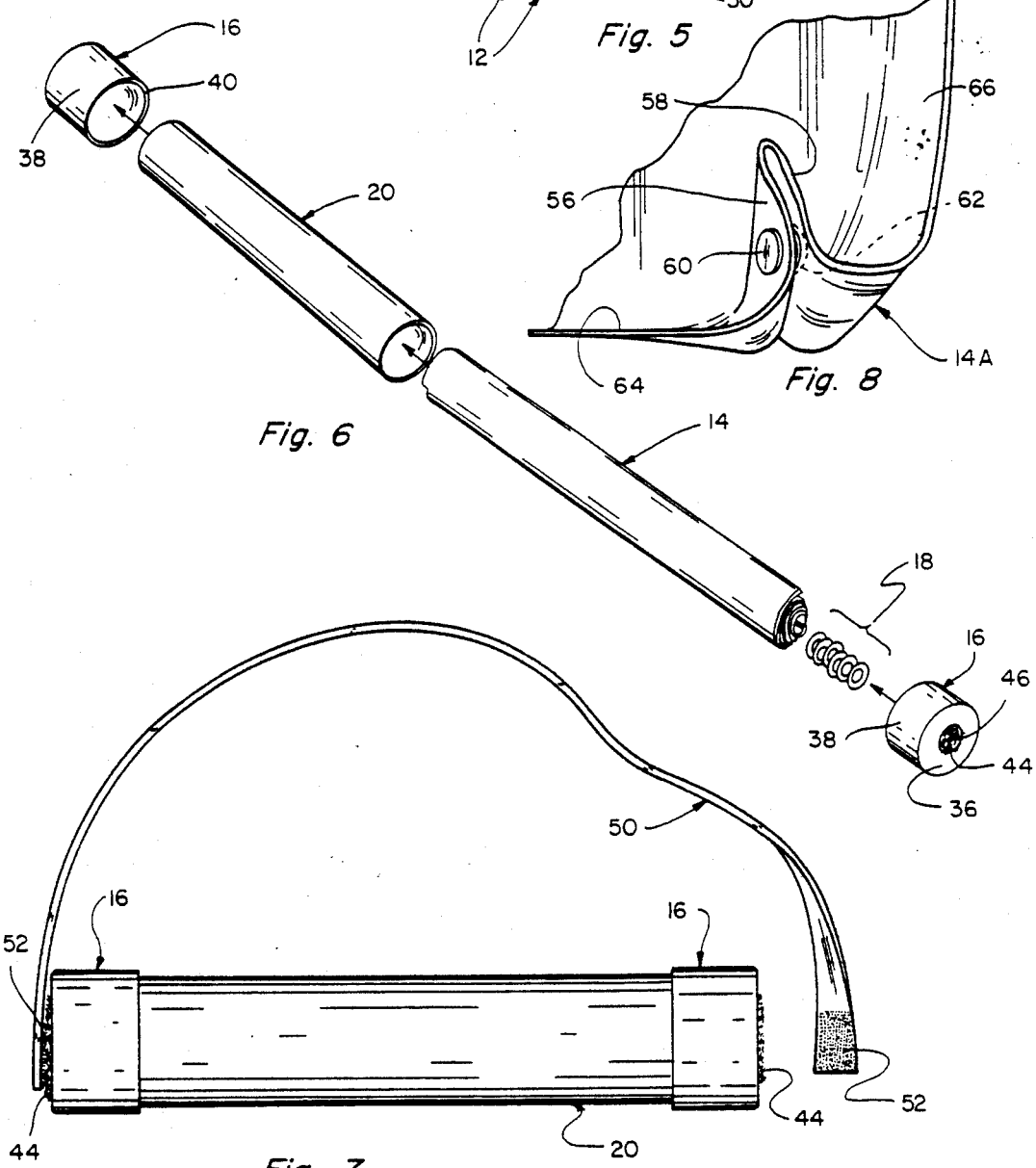
Fig. 6
Fig. 7

TOSSING GAME APPARATUS

The present invention relates to tossing type games and more particularly to a portable toss type game including an improved target assembly having a cup shaped target member attached centrally to a flexible mat or pad having edge portions that are foldable and attachable to each other to form an upstanding side wall. The present game is suitable for both outdoor and indoor play and preferably includes two targets spaced a desired distance apart with one or more players standing near each target and tossing toward the other. An important feature of the present game is that when landing in the target, the playing pieces make relatively little noise and have a tendency to grab or bite and stop on or relatively close to their landing point and not bounce or ricochet away from the target. The mat may have a wide range of optional configurations from a substantially planar shape to configurations with varying degrees of curved and concave upstanding side walls which act to contain and limit the movement of the playing pieces after landing. The wide range of optional configurations enable varying or changing the degree of difficulty and level of skill and accuracy required and controlling the movement of the playing pieces after landing. When play is finished the targets may be disassembled by detaching the cup shaped target members from the pads. The pads may then be stacked and rolled or folded and placed in an accompanying optional open ended container or tube along with the playing pieces. The target cups may be engaged with the ends of the carrying tube to close the tube, or alternatively, also placed in the tube, with the tube containing the game components forming a convenient, relatively small, lightweight package or kit. The package is compact, easy to carry and may optionally include a carrying strap, handle or the like for added convenience.

BACKGROUND OF THE INVENTION

Numerous games exist in the prior art in which the object is to toss playing pieces and the like into or around a container or similar receiver member located on or in a surrounding enclosure. Reference may be made to U.S. Pat. Nos. 4,877,256 and 4,392,653, both of which disclose tossing games in which the object is to toss playing pieces into one or more small receivers located in upwardly open box-like enclosures. The existing tossing games are less than desirable for several reasons, including because the receivers, enclosures and playing pieces are generally constructed of relatively hard rigid materials which gives the playing pieces a tendency to bounce and ricochet when impacting the enclosures and receivers, making the games less desirable for indoor use because the pieces are more likely to leave the enclosure and strike nearby objects such as walls and furniture. The tendency of the playing pieces to bounce and ricochet also makes the game less dependent on the accuracy of the player's toss and more on the players ability to predict where the playing piece will bounce or ricochet. Another reason making the existing games less desirable is that the existing enclosures generally have only walls of fixed height oriented at fixed angles which are not adjustable, flexible or otherwise adaptable to change the degree of difficulty and skill required or to minimize bouncing and ricocheting when playing pieces land thereon. Further, the existing games disclose no means by which the box-like enclosures may be disassembled or compacted for storage and handling. The existing games are therefore bulky and inconvenient to transport and to store when not in use.

SUMMARY OF THE INVENTION

The present invention overcomes many of the undersirable limitations and shortcomings of the known toss type games and teaches the construction and operation of an improved toss type game having several novel features not found in the existing games. Important among the novel features of the present game is a target constructed of a relatively flexible material which may be bent or folded to form upstanding side walls and which acts to dampen and limit the movement of playing pieces received thereby. The present target is able to comform somewhat to the surface on which it is located and may be configured into different shapes as desired to vary the degree of difficultly and skill level required to play the game. The present target may also be rolled up, folded or the like for insertion into an optional carrying container for storage and handling The target includes a flexible base mat or pad member having foldable and bendable outer edge portions and a cup shaped target receiver or bulls eye member that is cooperatively engageable with the pad. The cup shaped target receiver member is also preferably relatively flexible for the same reasons as the mat is so constructed.

The flexibility of the pad member enables the target to conform somewhat to the surface on which it is located so that it can be used on flat surfaces as well as on surfaces such as gravel, soil, grass and like surfaces. Flexibility also enables bending or folding the outer edge portions to form upstanding side walls for creating a wide variety of shapes, including two or more sided enclosures or containers having sides of adjustable and variable height and curvature. The resulting side walls may be relatively straight or may be formed into rounded and inwardly facing concave shapes with the intersections between adjacent side walls and the remaining bottom portion additionally being curved or rounded. Importantly, the present base member creates a tendency for the tossed playing pieces to land and stick and not bounce and ricochet as is the tendency with the more conventional rigid box-like enclosures. The flexibility of the present base member also enables the base members to be configured into a variety of shapes for changing the degree of difficulty and skill level required to play and for greater containment of playing pieces.

Additionally, the present toss game may optionally include playing pieces which differ from those of existing games by having a plastic or plastic-like coating over disk shaped pieces such as a metal washers or similar members A soft plastic coating further dampens any tendency of the playing pieces to bounce and ricochet and increases the sticking action that occurs between the playing pieces and target thereby further limiting movement of the pieces after landing.

Another important feature of the present toss game is a cup shaped target receiver or bulls eye member which is removably attachable to the base member by cooperatively engageable means such as "VELCRO" type fasteners, snaps and the like. The present target receiver may be formed of flexible material like the base member to similarly dampen and limit the movement of the playing pieces, or may be as rigid and hard as desired. When play is finished the receiver members may be detached from their respective surrounding pads and the pads rolled up or folded and placed along with the playing pieces in an optional carrying container with the cups being cooperatively engageable with the carrying container and used to close the ends of the carrying container. Alternatively, the target cups may also be placed inside the carrying container with the base member.

When the pads are rolled up and placed in the carrying container with the playing pieces and the target cups are engaged with the ends of the container, a package or kit is formed which is relatively compact and easy to handle and store. The present toss game is thus easier to carry and store than know to existing games having rigid components that do not substantially disassemble. These features make the present game more convenient and desirable for transporting to parties, picnics, backyard events and the like. The game is also more fun to play because of the construction of the components as described above.

It is therefore a principal object of the present invention to teach the construction of an improved toss type game apparatus which can be packed into a small space for ease of storage and handling.

Another object is to teach the construction of a toss game apparatus in which the tossed playing pieces tend to stick and not bounce and ricochet when striking the target.

Another object is to teach the construction of an improved tossing game apparatus which may be easily and quickly assembled and disassembled and which when disassembled may be conveniently stored and transported in an accompanying container which is relatively compact and easy to carry.

Another object is to teach the construction of an improved tossing game apparatus which makes the accuracy of tossing more important than predicting bouncing and ricocheting movements that occur after the playing pieces land on the target.

Another object is to teach the construction of a toss type game wherein portions of the game also serve as parts of the transporting and storage container therefor.

Another object is to teach the construction of an improved tossing game apparatus having targets which can be easily and quickly converted from a free state configuration to a wide variety of alternative configurations having one or more side wall portions of variable height and curvature to vary the difficulty and level of skill required to play the game.

Another object is to teach the construction of a toss type game apparatus that is suitable for indoor and outdoor use.

Another object is to teach the construction of an improved tossing game apparatus which is relatively inexpensive and simple to construct.

These and other objects and advantages of the present device will become apparent after considering the following specification in conjunction with the accompanying drawings wherein:

Brief Description Of The Drawings

FIG. 5 is a perspective view showing a pair of the target assemblies being rolled together into a cylindrical form for insertion into the carrying container;

FIG. 6 is an exploded view of the subject game showing how the various components are assembled together for insertion into the carrying container;

FIG. 7 is a side elevational view showing the carrying container in fully packaged condition; and FIG. 8 is an enlarged fragmentary perspective view showing an alternative version of a corner of the target assembly.

DETAILED DESCRIPTION OF THE PREFERRED EMBODIMENT

Figure 1:
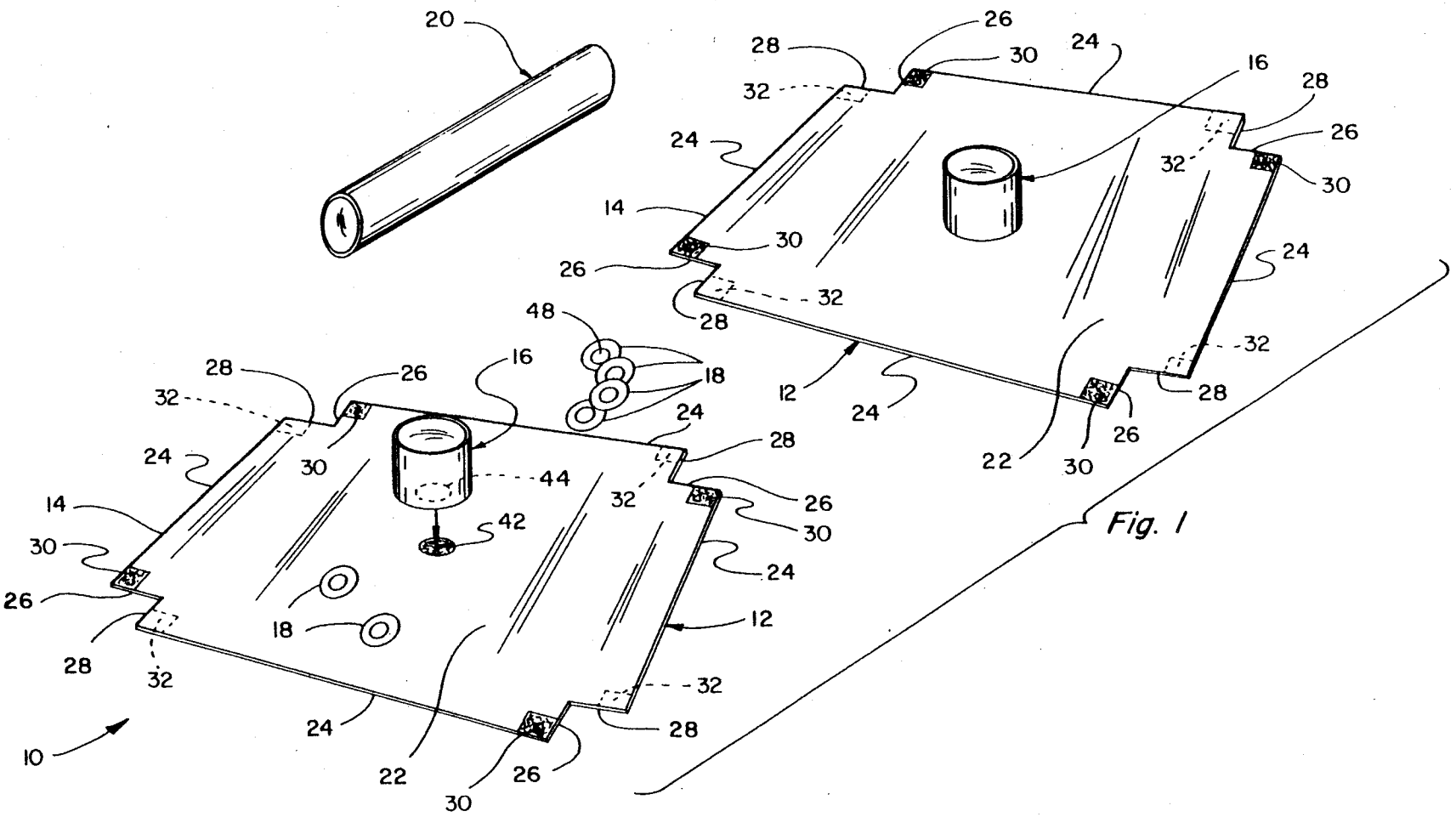
FIG. 1 is a perspective view of the components of an improved tossing game apparatus constructed according to the teachings of the present invention, the game including a pair of target assemblies including the bulls eye members and base pad members, a plurality of playing pieces and a carrying container for storing and transporting the game.

Referring to the drawings more particularly by reference numbers, wherein like numerals refer to like parts, number 10 in FIG. 1 identifies a toss type game apparatus having a pair of substantially similar targets or target assemblies 12 each comprising a flexible base pad or mat member 14 and a target receiver or bulls eye member 16 shown located at approximately the center of one side of each of the base pads 14. The game also includes a plurality of playing pieces shown as washers 18, and an optional carrying container or tube 20. To set up and play the present tossing game as shown requires that the pair of target assemblies 12 be spaced a desired distance apart and one or more players stand close to each target assembly 12 and toss playing pieces 18 toward the other trying, like in horse shoes, to score points by landing the playing pieces 18 in or around the receiver or bulls eye member 16. To vary the degree of difficulty, the target assemblies may be placed different distances apart, with as a general rule, the farther apart the assemblies, the more challenging the game. Additionally, as is discussed in greater detail below, the configuration of the pads 14 may be altered or modified to change the degree of difficulty and the skill level required, and to make the game suitable for play indoors or outdoors and in crowded and close spaces as well as in open areas.

The preferred construction of base pad members 14 is a relatively thin, flexible member having a generally rectangular or square shape with portions of the four corners of the rectangle optionally modified or removed to facilitate shaping and attaching the edge portions as will be explained. The optional spaces or gaps left by modification or removal of the corners of the base pad members 14 are shown as rectangular, but may, like the base member itself, be of any desired shape such as round, triangular or the like, with equal utility. Each base pad member 14 has a centrally located center portion 22 and four attached peripheral edge portions 24 surrounding and extending outwardly from center portion 22. The edge portions 24 each have cooperatively engageable first and second ends 26 and 28, with the first end 26 of each edge portion 24 being in proximity to the second end 28 of the adjacent edge portion 24 and separated therefrom by the spaces or gaps left by removal of the corners. The flexibility of the base members 14 tend to dampen the impact and limit bouncing movements of playing pieces 18 that land on the base member 14. Additionally, the gripping action between the surfaces of base members 14 and the playing pieces 18 reduces any tendency for the playing pieces to skid, skip or slide on impact. These properties substantially reduce the tendency for the playing pieces 18 to bounce or ricochet and fly off of the target assembly 12 after landing so as to make the present game more of a test of throwing accuracy and more suitable for play indoors and in close and crowded spaces where there is risk that the playing pieces 18 will strike and damage nearby objects. This also reduces the need for such tactics as playing the bounces and predicting bounces and ricochets as has been true of known toss type games.

Figure 2:
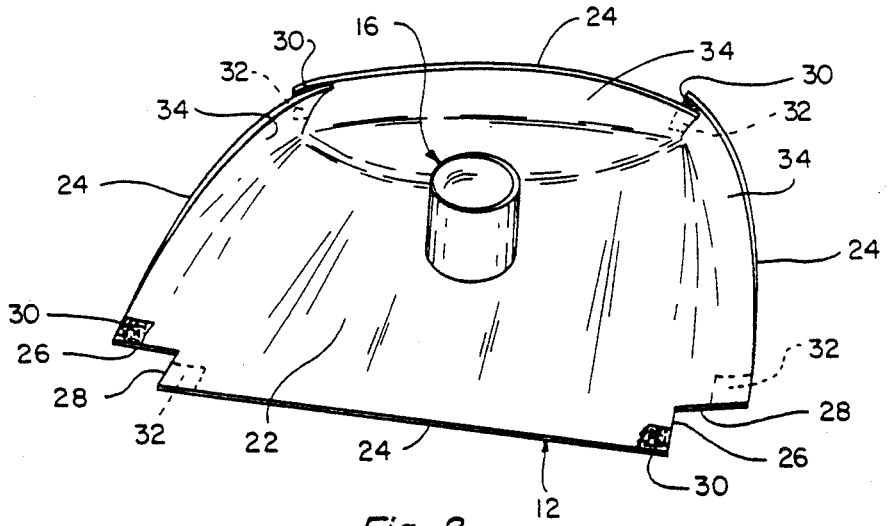
FIG. 2 is a perspective view of one of the target assemblies of FIG. 1 showing adjacent corner portions thereof joined together in one playing configuration.
Figure 3:
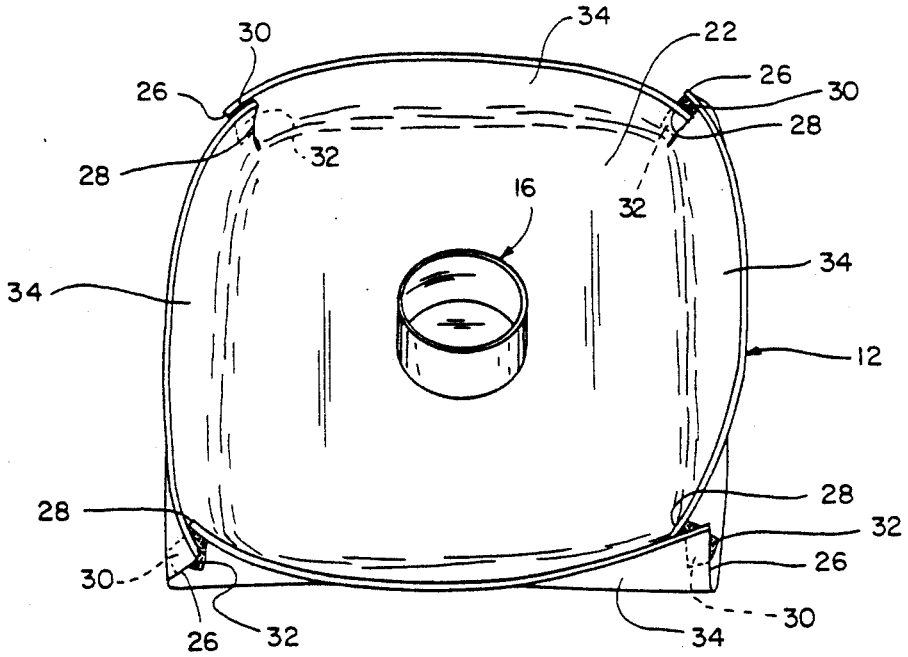
FIG. 3 is a perspective view of one the target assemblies of FIG. 1 showing all of the corners joined together to form a closed sided configuration.

The target assemblies 12 can be located on any kind of surface including on a carpet and other flooring, on grass, earth, sand, rocky and other irregular surfaces. The flexibility of base pad members 14 enable the base pads to conform to the surface on which it is positioned so as to be stable thereon and not rock or tip as may occur with base members of more rigid construction. Importantly, the flexibility of base members 14 also enable changing the configuration of the target assemblies 12 for varying the degree of difficulty and skill level required to play the game and for controlling and containing the movement of playing pieces 18 after landing. The base pads 14 may be flexed, folded and bent in any number of ways, preferably having one or more peripheral edge portions 24 directed upwardly and angularly relative to the center portion 22. When two or more adjacent edge portions 24 are angularly oriented, the first end portion 26 of one and the second end portion 28 of the other can be brought together and attached with cooperatively engageable means 30 and 32 to form free standing side wall portions 34 as shown in FIGS. 2 and 3. The cooperatively engageable means 30 and 32 are located adjacent the first and second end portions 26 and 28 and can include hook and loop type fastening means such as "VELCRO" brand fasteners, or alternatively may include other suitable type fastening means such as snaps, buttons, adhesive strips, hooks, buckles and the like. Hook and loop fastening means are preferred because they enable fastening the end portions in a variety of positions and orientations, the range of positions and orientations being limited only by the size of the fasteners. The preferred hook and loop type fastening means 30 and 32 enable adjacent edge portions 24 to be engaged in a variety of different positions such that the side wall portions 34 may also be of different heights as desired. The corners of the pads can be notched as shown or can simply be folded into a gusset and attached by the fasteners.

Numerous variations in degree of difficulty and skill level required to play may be created by connecting adjacent edge portions 24 in different ways. For instance, two adjacent edge portions 24 may be joined to create a two sided enclosure. Similarly, three edge portions 24 may be joined to create a three sided enclosure or container and all four edge portions 24 may be joined to create a four sided open top enclosure or container, the sides of which may be of different heights as desired. The flexibility of the base members 14 also enable the shape of the side wall portions 34 to be variable both horizontally and vertically from substantially straight through a range of curved, arced and concave shapes. Each wall 34 may also be uniformly shaped, or alternatively may vary in shape along its length, for instance being relatively concave adjacent first and second end portions 26 and 28 and relatively straight near the center, as shown in FIG. 3.

The height and shape of the side wall portions 34 affect and to some extent control the movement of the tossing pieces 18 after landing in the enclosure thereby also affecting the degree of difficulty of the game. Generally, the higher and more concave the side walls 34, the more likely it is that a playing piece 18 will remain in the target assembly 12 after landing. For instance, with the base pad members 16 in a substantially flat configuration such as shown in FIG. 1, tossing pieces 18 may have a greater tendency toward rolling, skidding or bouncing off of the base pad member 14, making the game more difficult. Alternatively, with low side wall portions 34 the tossing pieces 18 have a somewhat greater tendency to stay on the base pad member 14. Likewise, with very high and concave shaped side wall portions the tendency for the tossing pieces 18 to stay within the enclosure is still greater, thus making the game somewhat easier to play.

Figure 4:
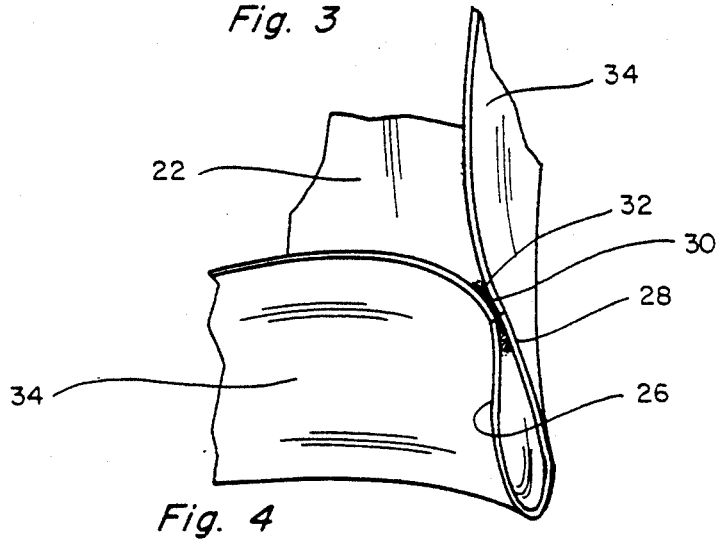
FIG. 4 is an enlarged fragmentary perspective view of a target assembly of FIG. 1 showing another alternative method of joining adjacent corners.

In addition to the flexibility of base member 14, the relative positions of fastening means 30 and 32 also influences the shape of wall portions 34. The preferred hook and loop type fasteners may generally be fastened together in many different orientations and positions, limited only by the size of the fasteners as discussed above. Combined with the flexibility of base member 14, the many orientations and positions for attaching fastening means 30 and 32 enables the side wall portions 34 to be made more or less curved or concave, as desired, and additionally enables the intersections and overlappings of adjacent side walls 34 to be as arced or curved as desired. For instance, FIG. 3 shows the respective fastening means 30 and 32 connected at an angle such that the intersections of the adjacent side walls 34 are relatively curved and additionally, the side walls 34 are significantly more concave at the intersections than at their middle portions. In contrast, reducing the angular relationship of the attachment means 30 and 32 would have a tendency to make the intersections more angular and less curved and concave. The fastening means 30 and 32 are shown in FIGS. 1, 2 and 3 with means 30 located on the inside or topside of member 14 and means 32 located on the outside or underside of member 14. In this way the fastening means may be attached as shown in FIGS. 2 and 3 with the first ends 26 containing means 30 overlaying and outside with the second ends 28 containing means 32. Alternatively, means 30 and 32 may be located on the same side of member 14, as shown in FIG. 4. Such an alternative location causes the attached end portions 26 and 28 to be in a more pinched together configuration forming outwardly curving intersections.

In addition to the capability of being able to locate the pads on irregular surfaces and the multiplicity of configurations afforded by the flexibility thereof, flexibility also enables the base members when the side walls are detached from each other to lay flat and to be rolled up into a relatively compact cylindrical shape as will be discussed in greater detail below. This capability enables two or more base members 14 to be rolled up together for inserting into carrying tube 20 for transportation and storage purposes. Such capability enables the present target assemblies 12 to be quickly and easily assembled and disassembled and when opened up the target cups 16 can be attached to base members 14 by cooperatively engageable means similar to the fastening means 30 and 32. When rolled up, the base members 14 may be inserted in the carrying tube 20 along with playing pieces 18 and the target cups 16 can be used to close the ends of tubular member 20 as shown in FIG. 6.

The target receivers or cups 16 are shown as being of generally cylindrically shape each having closed end wall 36, an endless side wall 38 and an oppositely facing open end 40. The target cups 16 like the mats are preferably but not necessarily constructed of a somewhat flexible cushioned material for dampening and limiting the movement of playing pieces 18 which strike and land on or in them. This flexibility enables tight and secure engagement with the end portions of carrying tube 20.

Located at or near the center of each mat 14 are additional fastening means 42 which are selectively engageable with mating fastening means 44 located on the bottom wall 36 of each target 16. Like fastening means 30 and 32, fastening means 42 and 44 are preferably of the hook and loop "VELCRO" type, but other suitable fastening means such as mentioned above may also be used.

When it is desired to disassemble target assemblies 12, the cups 16 can be pulled free from the base pads or mats 14. To facilitate installing the cups on the ends of the tube 20 a hole such as hole 46 may be formed in the cups to allow air to escape when the cup is installed.

The playing pieces 18 are preferably disk type washers with apertures 48 through approximately the center thereof. It is also preferred that the playing pieces 18 have a coating of a plastic type material which helps to dampen bouncing and ricocheting and increases the gripping action between playing pieces 18 and the mats 14. This reduces the tendencies of the playing pieces to bounce, skid, skip, or slide off or out of base members 14 and target cups 16. This is an important distinction between the present game and known toss type games.

As discussed above, when play is finished target cups 16 may be detached from base members 14, base members 14 rolled up individually or together and inserted along with playing pieces 18 into the optional carrying container 20 as shown in FIG. 6. The target cups 16 are then engaged with the ends of carrying container 20 to complete the closure and to form a convenient and compact carrying package or kit as shown in FIG. 7. The tubular container 20 is shown as a substantially rigid member and is of sufficient size to contain the rolled up base members 14 and the playing pieces 18. The carrying tube 20 may optionally include a carrying strap 50 having cooperatively engageable means 52 which are engageable with means 44 of the receivers 16 as shown in FIG. 7, or alternatively, a carrying handle or like member. When in kit form, the present game 10 is compact and convenient to carry and store.

FIG. 8 shows another version of a corner of base member 14 and the cooperatively engageable means for attaching the corner to form an upstanding corner. This version shows a corner 54 of base member 14A which has foldable portions 56 and 58 with snap fasteners 60 and 62 engaged forming adjacent upstanding side walls 64 and 66. The corner 54 may be as shown in FIG. 8 or alternatively can be attached to either adjacent side wall 64 or 66.

Thus there has been shown and described preferred embodiments of a novel toss type game apparatus, which apparatus fulfills all of the objects and advantages sought therefor. Many changes, modifications, variations and other uses and applications of the present tossing game apparatus will, however, become apparent to those skilled in the art after considering the specification and the accompanying drawings All such changes, modifications, variations and other uses and applications which do not depart from the spirit and scope of the invention are deemed to be covered by the invention which is limited only by the claims which follow.

What is claimed is:

1. A target apparatus for receiving tossed playing pieces comprising:

a target assembly including a flexible mat having a central portion and at least two adjacent peripheral wall portions having end portions with cooperatively engageable means thereon, the cooperatively engageable means on adjacent peripheral wall portions being engageable to hold the peripheral wall portions in folded outwardly extending relation to the central portion, and a cup shaped target receiver member with means for attaching the target receiver member to the central portion of said mat.

2. The target apparatus of claim 1 wherein said mat is formed of a flexible rubber-like material.

3. The target apparatus of claim 1 wherein said cooperatively engageable means include "VELCRO" type fasteners.

4. The target apparatus of claim 1 wherein said mat is square in shape and has pairs of opposed peripheral wall portions.

5. The target apparatus of claim 1 including packaging means for the target apparatus, said packaging means including an open ended tubular member large enough to receive the playing pieces and the mat when the mat is rolled up.

6. The target apparatus of claim 5 wherein the cup shaped target member is cooperatively engageable with the tubular member closing one end thereof.

7. The target apparatus of claim 5 wherein two similar flexible mats and cup shaped target receiver members are provided and the tubular member is large enough to receive both mats when rolled up.

8. The target apparatus of claim 5 including carrying handle means.

9. The target apparatus of claim 1 wherein the cooperatively engageable means include snap fasteners.

10. In a game where disk-like members are tossed at a remote target including a platform and a cup shaped member positioned at a central location on the platform, the improvement residing in the construction of the platform and the cup shaped member attached thereto, said platform including a flexible mat having a central portion and a plurality of elongated edge portions extending around the periphery thereof, each peripheral edge portion having opposed ends and cooperatively engageable fastener means adjacent to each of the opposed ends of each edge portion for engagement with the fastener means adjacent to the end of the adjacent edge portion whereby when the fastener means on adjacent edge portions are fastened together the corresponding edge portions will extend outwardly from the plane of the central portion to enclose a space around one surface of the central portion of the mat, and other cooperatively fastener means on the cup shaped member and on the central portion of the mat for attaching the cup shaped member to the mat.

11. A target apparatus for tossing playing pieces at comprising:

a target assembly including a flexible mat having a peripheral edge extending therearound, means adjacent to the corners of the flexible mat such that when portions around the periphery of the mat are folded out of the plane of the mat, the folded portions can be attached together to maintain that position, and a cup shaped target receiving member with means for attaching the target receiving member to the center portion of the mat.

* * * * *